US006907874B1

(12) United States Patent
Faircloth

(10) Patent No.: US 6,907,874 B1
(45) Date of Patent: Jun. 21, 2005

(54) CONCRETE HOLE CUTTING MACHINE

(76) Inventor: Terry Faircloth, 107 Ashley La., Dunn, NC (US) 28334

( * ) Notice: Subject to any disclaimer, the term of this patent is extended or adjusted under 35 U.S.C. 154(b) by 0 days.

(21) Appl. No.: 10/843,176

(22) Filed: May 11, 2004

(51) Int. Cl.[7] ..... B24D 1/04
(52) U.S. Cl. ..... 125/13.01; 125/13.02; 125/12; 125/14; 299/41.1; 172/98
(58) Field of Search ..... 125/13.03, 12, 125/14, 13.01, 16.01, 20; 299/58, 59, 39, 299/39.1, 39.3, 36.1, 37.1, 93.1, 37.2, 41.1; 180/211, 213, 214; 404/90; 156/584; 172/98

(56) References Cited

U.S. PATENT DOCUMENTS

| | | | | | |
|---|---|---|---|---|---|
| 3,848,687 | A | * | 11/1974 | Funakubo | 175/394 |
| 4,013,133 | A | | 3/1977 | Bieri | |
| 4,287,955 | A | * | 9/1981 | Anderson | 172/98 |
| 4,458,949 | A | * | 7/1984 | Jury | 299/41.1 |
| 4,572,580 | A | | 2/1986 | Bieri | |
| 4,848,845 | A | | 7/1989 | Kennedy | |
| 4,878,713 | A | * | 11/1989 | Zanetis | 299/39.5 |
| 4,924,951 | A | | 5/1990 | Paulson | |
| 4,968,101 | A | * | 11/1990 | Bossow | 299/41.1 |
| 5,104,195 | A | | 4/1992 | Zaccho | |
| 5,139,006 | A | | 8/1992 | Trudeau | |
| 5,203,615 | A | * | 4/1993 | Zanetis et al. | 299/39.5 |
| 5,245,982 | A | | 9/1993 | Trudeau | |

(Continued)

OTHER PUBLICATIONS

"Kor-It-K-700HRxx System," http://www.kor-it.com/bucket-skid-core-drills.htm.

*Primary Examiner*—George Nguyen
(74) *Attorney, Agent, or Firm*—Coats & Bennett, P.L.L.C.

(57) ABSTRACT

A machine for cutting holes in concrete slabs comprises a connector adapted to be secured to an adapter of a front-end loader. Secured to the connector is a first frame structure that includes an elongated tube and a support foot for engaging the surface of a concrete slab and supporting the first frame structure. Confined within the elongated tube of the first frame structure is a beam that is slidable back and forth therein. One end portion of the beam extends from the elongated tube. A second foot structure extends downwardly from the one end portion of the beam to where it may engage the surface of the concrete slab. Secured directly or indirectly to the elongated beam is a concrete hole cutting saw unit that includes a drum type concrete saw. Interconnected between the beam and the first frame structure is a hydraulic cylinder that is operative to move the elongated beam and saw cutting unit back and forth between a retracted and extended position. Accordingly, the concrete saw can be moved back and forth, laterally with respect to the front-end loader. By raising lift arms associated with the front-end loader, the concrete hole cutting machine can be moved from location to location. In use, the lift arms are lowered to where the two feet engage the upper surface of the concrete slab and the concrete saw is lowered into engagement with the concrete slab and by driving the concrete saw a circular hole is cut in the concrete slab.

31 Claims, 6 Drawing Sheets

U.S. PATENT DOCUMENTS 5,388,893 A * 2/1995 Maxwell et al. ..... 299/39.6
5,421,669 A * 6/1995 Bertrand ..... 404/90
5,689,072 A 11/1997 Chiuminatta et al.
5,724,956 A * 3/1998 Ketterhagen ..... 125/13.01
5,921,228 A 7/1999 Watson
5,950,612 A 9/1999 Zuzelo et al.
6,058,662 A 5/2000 Perko
6,112,736 A 9/2000 Bearden
6,203,112 B1 * 3/2001 Cook et al. ..... 299/39.3
6,227,620 B1 5/2001 Page
6,343,981 B1 * 2/2002 Buchanan ..... 451/350
6,470,874 B1 10/2002 Mertes

* cited by examiner

CONCRETE HOLE CUTTING MACHINE

FIELD OF THE INVENTION

The present invention relates to concrete saws and more particularly to a drum type concrete saw machine for cutting a hole in a concrete slab.

BACKGROUND OF THE INVENTION

Government safety regulations now require that posts be erected in some existing concrete slabs found in commercial and industrial sites. To erect a post in an existing concrete slab, requires that a circular hole be cut into and through the slab. Once a hole is cut into the slab a post is inserted into the hole and securely stationed therein by conventional means. The problem lies in cutting the circular hole in the concrete slab. This task is difficult, time consuming and in the end very expensive. Typically circular holes are cut in concrete slabs by a drum type concrete saw that is adjustably supported for up and down movement on a post that is in turn supported on a platform that rests on the concrete slab. However, it is important that the platform that supports the concrete saw be stable. In order to stabilize the platform during a hole cutting operation, the platform is typically bolted to the concrete slab prior to moving the saw into engagement with the concrete. Simply bolting and securing the supported platform to the concrete slab is time consuming. In any event, once the platform is bolted to the concrete slab, the circular drum saw is lowered into engagement with the concrete slab. An operator controls the lowering of the saw and once the saw comes into contact with the surface of the concrete slab, the operator simply continues to lower rotary saw such that it cuts through a concrete slab which would typically be approximately 8" thick. Once the concrete saw has cut through the slab, the cut chunk of concrete, which is cylindrical in shape, is removed and a post inserted into the hole.

Concrete saws of the type discussed above are not portable. Therefore the entire concrete saw along with the platform has to be moved to another location on the slab for cutting the next hole. This process is inconvenient and as noted above, a great deal of time and effort is expended in cutting each hole.

Therefore, there has been and continues to be a need for a machine for cutting holes in concrete that will efficiently and cost effectively cut holes in concrete.

SUMMARY OF THE INVENTION

The present invention relates to a concrete hole cutting machine that is adapted to mount to a lift arm of a prime mover such as a front-end loader. The machine comprises a connector for mounting the concrete hole cutting machine to one or more lift arms of the prime mover. A first frame structure is coupled to the connector. A second frame structure is extendably and retractably coupled to the first frame structure and adapted to support a concrete hole cutting saw. The second frame structure is movable back and forth with respect to the first frame structure. An actuator is provided for extending and retracting the second frame structure with respect to the first frame structure. It follows that the position of the concrete hole cutting saw supported by the second frame structure can be adjusted and varied by actuating the actuator which causes the second frame structure to be extended or retracted with respect to the first frame structure.

The present invention in one embodiment entails a concrete hole cutting machine that is adapted to be mounted to a front-end loader or other vehicle or prime mover. The machine comprises a first frame structure and a connector that extends from the first frame structure and connects to the adapter of the front-end loader such that the first frame structure is connected to the front-end loader. A second frame structure is provided and this frame structure supports a rotary concrete cutting saw. The first and second frame structures include a telescoping structure that includes one member that slides back and forth in a second member. The telescoping structure is oriented with respect to the connector such that the second frame structure and saw supported directly or indirectly thereby can be moved back and forth laterally with respect to the front-end loader when the concrete hole cutting machine is connected to the loader. A hydraulic cylinder is interconnected between the first and second frame structures for moving the second frame structure and the concrete cutting saw laterally back and forth between a retracted position and an extended position.

Therefore, it is appreciated that the concrete hole cutting machine can be easily positioned such that the concrete cutting saw overlies and aligns with a target area to be cut. That is, the concrete saw can be first positioned with respect to a target area by simply positioning the front-end loader or tractor to where the concrete saw lies close to or in the vicinity of the target area. Next, the second frame structure can be shifted laterally back and forth with respect to both the first frame structure and the loader such that the concrete saw lies precisely over the target area. Then the concrete saw can be lowered into engagement with the target area for cutting a hole in the concrete slab.

The present invention also entails a method of aligning a drum type of concrete hole cutting saw with a target area in a concrete slab. A concrete hole cutting machine is mounted to a vehicle such as a front-end loader and the vehicle or front-end loader is positioned such that the concrete saw lies relatively close to a target area in a concrete slab. The concrete saw is mounted to a frame structure that can be shifted back and forth with respect to the vehicle or loader. Thus once the loader or vehicle has positioned the saw relatively close to the target area, then the saw can be shifted laterally back or forth to where the saw precisely overlies the target area. Then the drum type concrete saw can be lowered into cutting engagement with the underlying concrete slab.

More particularly, and in one embodiment, the present invention entails a method of cutting a hole in a concrete slab with a concrete cutting machine having a drum type rotary cutting saw where the machine is mounted to a front-end loader. The method includes raising the concrete hole cutting machine off the surface of the concrete and moving the front-end loader to a position where the saw is located in the vicinity of the target area or where a hole is to be cut in the concrete. Then the method entails laterally shifting the saw relative to the front-end loader to where the saw aligns with the target area or the area where the hole is to be cut into the concrete. Once aligned, the concrete hole cutting saw is lowered into engagement with the concrete in the target area. Thereafter the concrete saw is continued to be lowered into engagement with the concrete where the concrete saw cuts a hole into the concrete.

Other objects and advantages of the present invention will become apparent and obvious from a study of the following description and the accompanying drawings which are merely illustrative of such invention.

DESCRIPTION OF THE INVENTION

Figure 1:
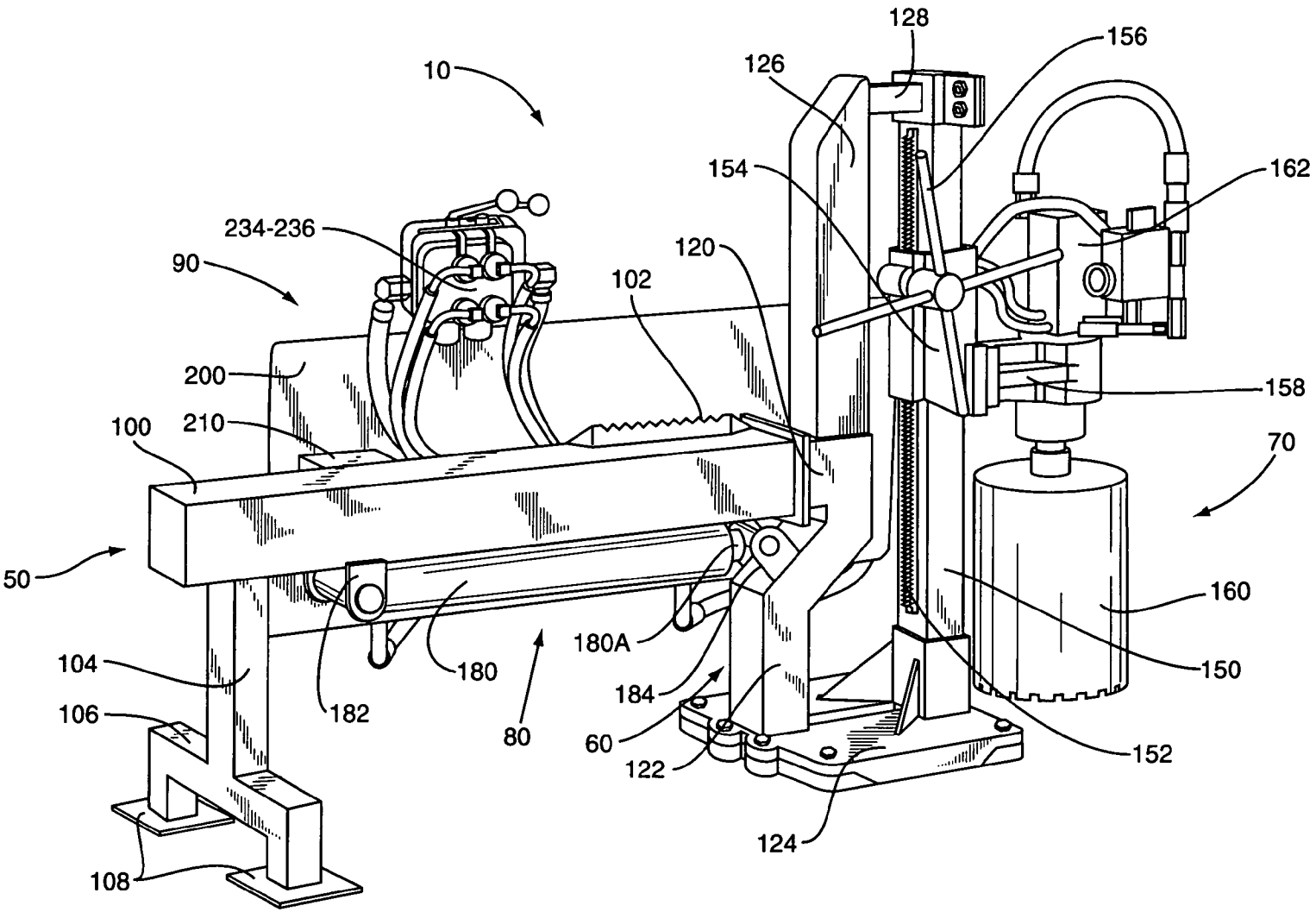
FIG. 1 is a perspective view of the concrete hole cutting machine of the present invention.

With further reference to the drawings, the concrete hole cutting machine of the present invention is shown therein and indicated generally by the numeral 10. As will be appreciated from subsequent portions of the disclosure, machine 10 is designed to cut holes in concrete slabs. Machine 10 is designed to be connected to a front-end loader indicated generally by the numeral 12. When connected to the front-end loader 12, machine 10 can be easily moved from one location to another location on a concrete slab and appropriately aligned with a target area such that a concrete saw, forming a part of the machine, may be lowered into engagement with the underlying concrete slab and a hole or cylindrical chunk of concrete cut from the slab.

Briefly reviewing front-end loader 12, it is noted that details of the front-end loader 12 are not dealt with herein because such is not per se material to the present invention and further front-end loaders are well known in the art and are manufactured and sold by a number of manufacturers. In any event, front-end loader 12 includes a pair of hydraulically actuated lift arms 14, a plurality of wheels 16 and a cab 18. In conventional fashion, the front-end loader 12 is typically a skid steer vehicle and includes an onboard hydraulic system that powers a hydrostatic drive, the lift arms 14 and various implements that might be connected to the front-end loader 12. It should be noted that the concrete hole cutting machine 10 could be connected to various prime movers, tractors and other vehicles. In a preferred use, the prime mover, tractor or vehicle would have the capacity to lift the hole cutting machine 10 and move it from location to location. Accordingly, the vehicle that the concrete hole cutting machine 10 is connected to should be provided with one or more lift arms. Herein the term "front-end loader" has been used to refer to the vehicle to which the concrete hole cutting machine is connected. Thus, as used herein, the term "front-end loader" means any type of prime mover, tractor or vehicle that is capable of connecting to and transporting the concrete hole cutting machine 10 from one location to another location.

Front-end loader 12 includes an adapter indicated generally by the numeral 20. Adapter 20 is a conventional structure provided about the front of a front-end loader for connecting to various implements such as a bucket. Basically the adapter 20 comprises a frame structure that is adapted to connect to or mate with a connecting structure associated with an implement or piece of equipment. Details of the adapter 20 are not discussed herein because they are commonly found on front-end loaders. However, in the case of the adapter 20 shown herein, the same includes a pair of levers 20A and 20B that actuate a pair of connecting pins (not shown). See FIG. 4. When levers 20A and 20B are appropriately actuated, the connecting pins are caused to move into engagement with a connecting structure associated with the implement or piece of equipment to be connected to the front-end loader 12. By the same token, levers 20A and 20B can be actuated or moved to cause the connecting pins (not shown) to disengage from the connecting structure of the associated implement.

Turning generally to the concrete hole cutting machine 10 of the present invention, the same comprises a number of subsystems or subassemblies. First machine 10 includes a first frame structure indicated generally by the numeral 50. As will be appreciated from subsequent portions of this disclosure, the first frame structure 50 is adapted to be secured through a connector to the adapter 20 of the front-end loader 12.

A second frame structure, indicated generally by the numeral 60, is provided. The second frame structure 60 is extendably and retractably coupled to the first frame structure 50. That is, second frame structure 60 can be extended and retracted with respect to the first frame structure 50. As is seen in the drawings (FIGS. 1 and 2), second frame structure 60 is designed to be moved laterally back and forth with respect to the front-end loader 12.

Supported on the second frame structure is a concrete hole cutting saw unit indicated generally by the numeral 70. It is thusly appreciated that the concrete saw unit 70 moves back and forth with the second frame structure 60. As will be appreciated from subsequent portions of the disclosure, the front-end loader 12 will first position the saw unit 70 relatively close to a target area TA that defines the location in the concrete slab where the hole is to be cut. Once the saw unit 70 is positioned relatively close to the target area TA, then the second frame structure 60 is utilized to position the saw unit directly over the target area TA.

In order to power the second frame structure 60 and move the same laterally back and forth with respect to the front-end loader 12, there is provided an actuator, indicated generally by the numeral 80. Actuator 80, as will be described in more detail later, is interconnected between the first frame structure 50 and the second frame structure 60 and is capable of driving the second frame structure 60 back and forth.

Finally, there is provided a connector, indicated generally by the numeral 90, which connects the first frame structure 50 to the adapter 20 of the front-end loader 12. Connector 90, as will be appreciated from the drawings, is fixed with respect to the first frame structure 50. Thus, when the adapter 20 of the front-end loader 12 is moved, both the connector 90 and the first frame structure 50 are constrained to move accordingly.

Turning to a more detailed discussion of the subassemblies or subsystems of the present invention, the first frame structure 50 includes an elongated tube 100. Tube 100 is closed on one end and open on the other end. A foot grip 102 is secured to the top of the tube 100. Extending downwardly from one end of the tube 100 is a foot or supporting structure. In the case of the design shown in the drawings, the foot or support structure includes a post 104. Connected to the lower portion of post 104 is a horizontal member 106. Extending from the horizontal member 106 is a pair of spaced apart supports 108. As will be appreciated from subsequent portions of this disclosure, when the hole cutting machine 10 is in operation on a concrete slab, this support structure will engage and rest upon the concrete slab.

Figure 2:
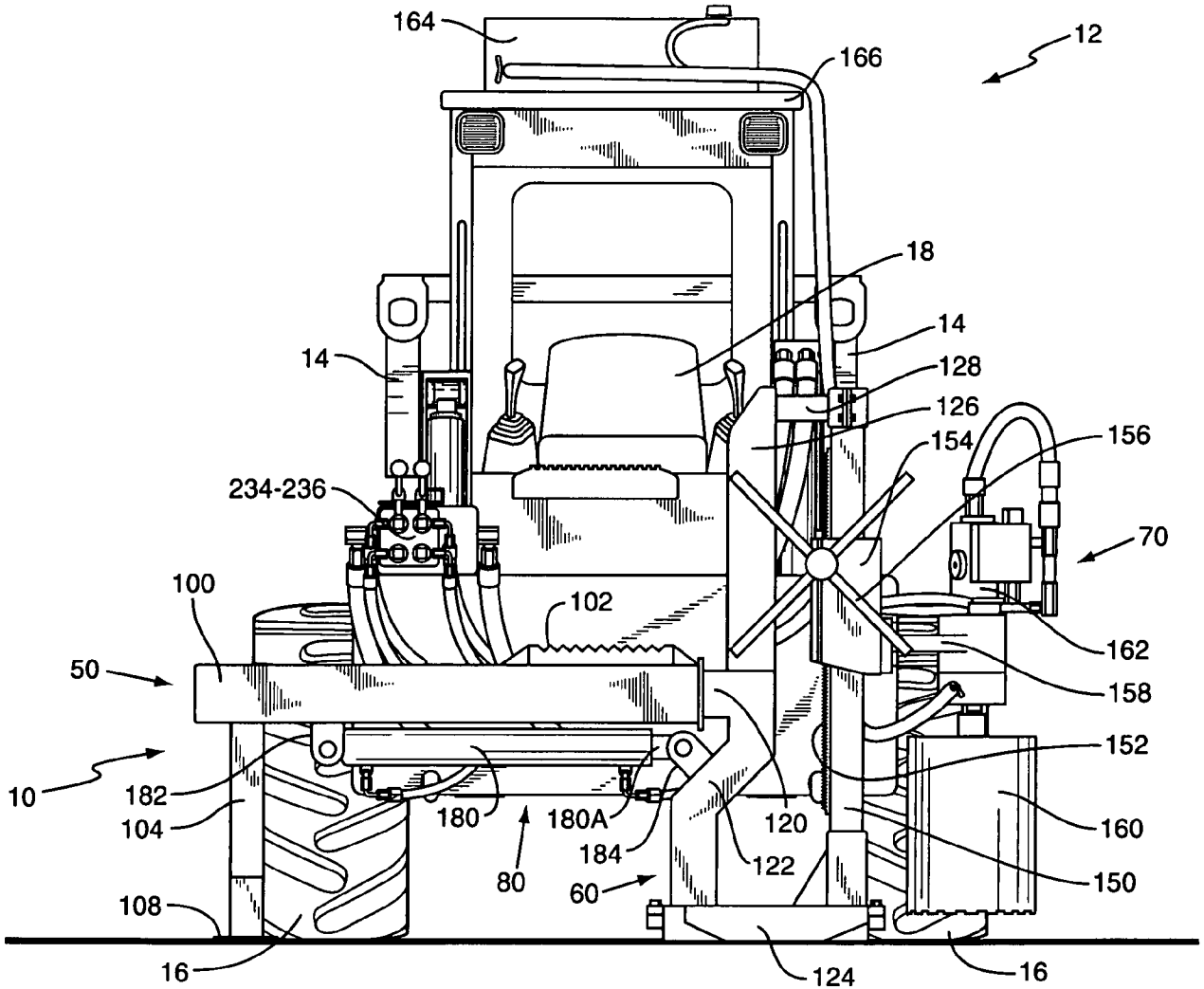
FIG. 2 is a front elevational view of the machine shown in the retracted position.

Second frame structure 60 includes an elongated beam 120. As seen in FIGS. 1 and 2, beam 120 projects into tube 100 and is confined therein. A portion of the beam 120 extends outwardly from the open end of the tube. As will be more fully appreciate from subsequent portions of this disclosure, beam 120 is permitted to reciprocate or move back and forth within tube 100.

Extending downwardly from the beam 120 is a foot or support structure that during a hole cutting operation will support at least part of the hole cutting machine 10. As seen in FIGS. 1 and 2, this foot or support structure includes a lower leg 122 that extends downwardly from the beam 120 and connects to a support or platform 124. The support or platform 124 in turn supports the saw unit 70 to be described below.

Extending upwardly from the beam 120 is an upper leg 126. Extending from an upper portion of the upper leg 126 is a cross connector 128. Upper leg 126 and cross connector 128 function also to help support and stabilize the saw unit 70.

Now turning to the saw unit 70, the same comprises a post 150 that is securely mounted or stationed to the support or platform 124. Post 150 extends vertically upwardly from the support or platform 124. The cross member 128 of the second frame structure connects to an upper portion of the post 150 and tends to stabilize the post. Post 150 is provided with an elongated gear track 152 that extends along one side of the post. A carrier 154 is mounted on the post 150 and movable up and down thereon. An actuator 156 in the form of a spoke wheel is associated with the carrier 154. Although not shown, the actuator 156 is coupled to a gear or gear assembly housed within the carrier 154, which meshes with the gear track 152 on post 150. Thus, by turning the spoke wheel 156 the carrier 154 can be moved along the post 150. That is, by turning the spoke wheel 154 in one direction causes the carrier 154 to move downwardly on the post 150. Turning the spoke wheel 156 in the opposite direction results in the carrier 154 moving upwardly on the post 150.

A support arm 158 is secured to the carrier 154 and extends outwardly therefrom. A drum type concrete hole cutting saw 160 is supported from the support arm 158. Details of the concrete hole saw 160 are not dealt with herein because such devices are known. Suffice to say that the concrete hole cutting saw 160 assumes a generally cylindrical shape and is made of heavy duty steel. About the lower periphery of the cylindrical drum there is provided a series of teeth that are effective to cut through a concrete slab when the drum type saw 160 is rotated.

Although the saw 160 can be driven in various ways, in the embodiment illustrated herein the saw is hydraulically driven by hydraulic motor 162. During a concrete hole cutting operation it is desirable to direct a small stream of water into the area where the teeth of the saw are cutting the concrete. To accommodate this the present invention provides a water tank 164 that is mounted on the cab of the front-end loader 12. Connected to the water tank 164 is a supply line 166 that extends downwardly from the water tank to the area where the concrete hole cutting saw 160 is located. During a hole cutting operation a valve can be actuated such that the water tank will supply, under the force of gravity, a light stream of water to the hole cutting saw 160.

To drive the second frame structure 60 back and forth, the actuator 80 includes a double acting hydraulic cylinder 180. See FIGS. 1 and 2. Hydraulic cylinder 180 is connected between the first frame structure 50 and the second frame structure 60. More particularly, the hydraulic cylinder 180 is anchored through a clevis 182 to the underside of elongated tube 100. The rod 180A of the hydraulic cylinder 180 is connected to a clevis 184 that is in turn connected to leg 122. Thus, by extending the rod 180, the beam 120 is driven from left to right as viewed in FIG. 1 and the hole cutting machine 10 is moved to an extended position. In addition, by retracting the rod 180A, the second frame structure 60 and the beam 120 are retracted and when retracted the hole cutting machine 10 assumes a retracted position shown in FIG. 1. The extended position just discussed is shown in FIG. 2.

Figure 4:
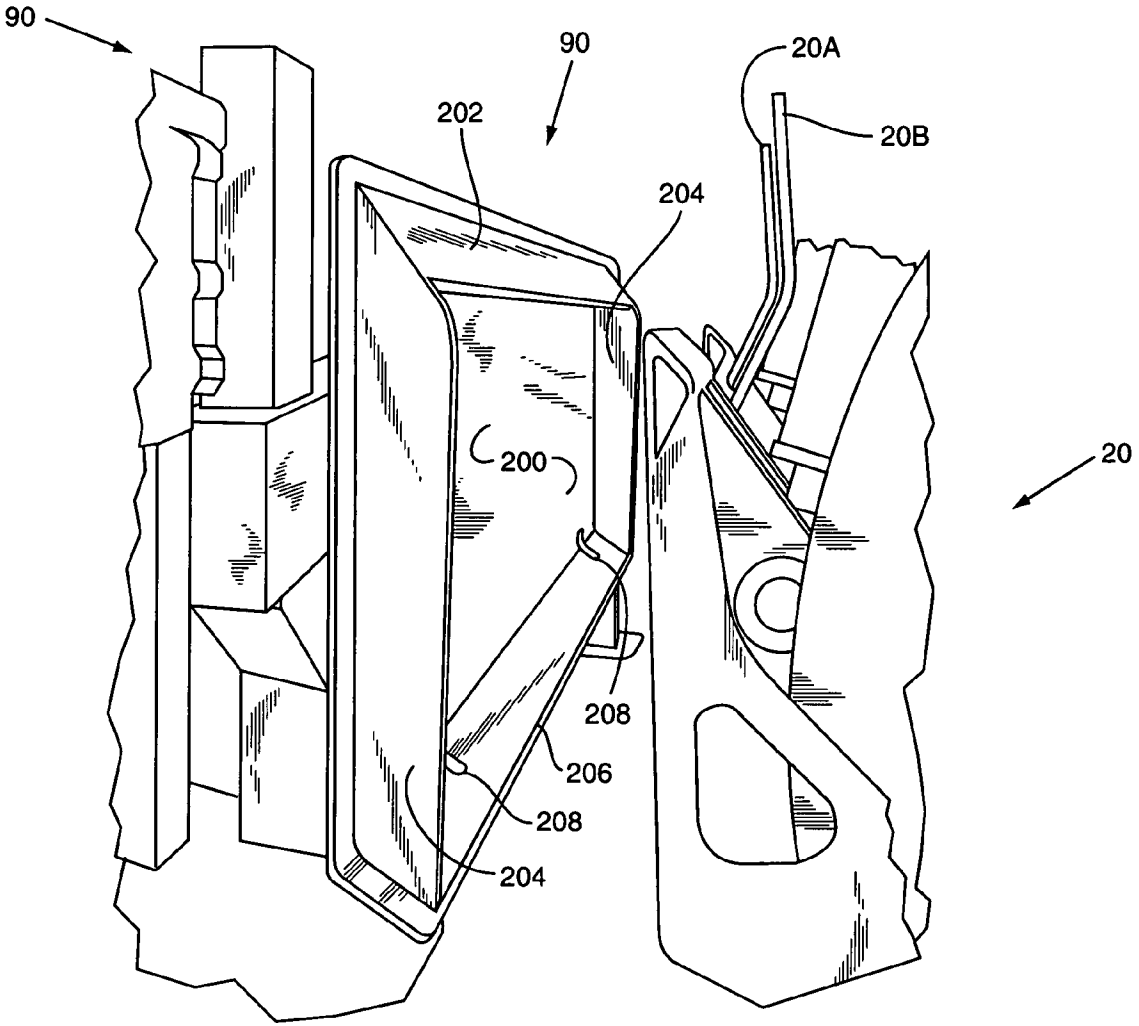
FIG. 4 is a fragmentary perspective view illustrating how the front end loader is connected to the machine.

Connector 90 is shown in FIG. 4 and has been briefly discussed above. Connector 90 includes a plate 200. Extending across the top of plate 200 is an upper angled flange 202. Extending along opposite sides of the plate 200 is a pair of side retainers 204. Extending across the bottom of the plate 200 is a lower flange 206 that includes a pair of openings 208. Openings 208 formed in the lower flange 206 are designed to receive the connecting pins (not shown) associated with the adapter 20. It should be appreciated, that the upper angle flange 202 and the other surrounding structure around the plate 200 are designed to enable the adapter 20 to be easily inserted and locked into the confines formed around the plate 200 by the upper flange 202, side retainers 204 and lower flange 206.

A pair of cross beam connectors 210 extend from the tube 100 and connect to the connector 90. Thus, as discussed above, connector 90 is coupled directly to the first frame structure 50.

Figure 6:
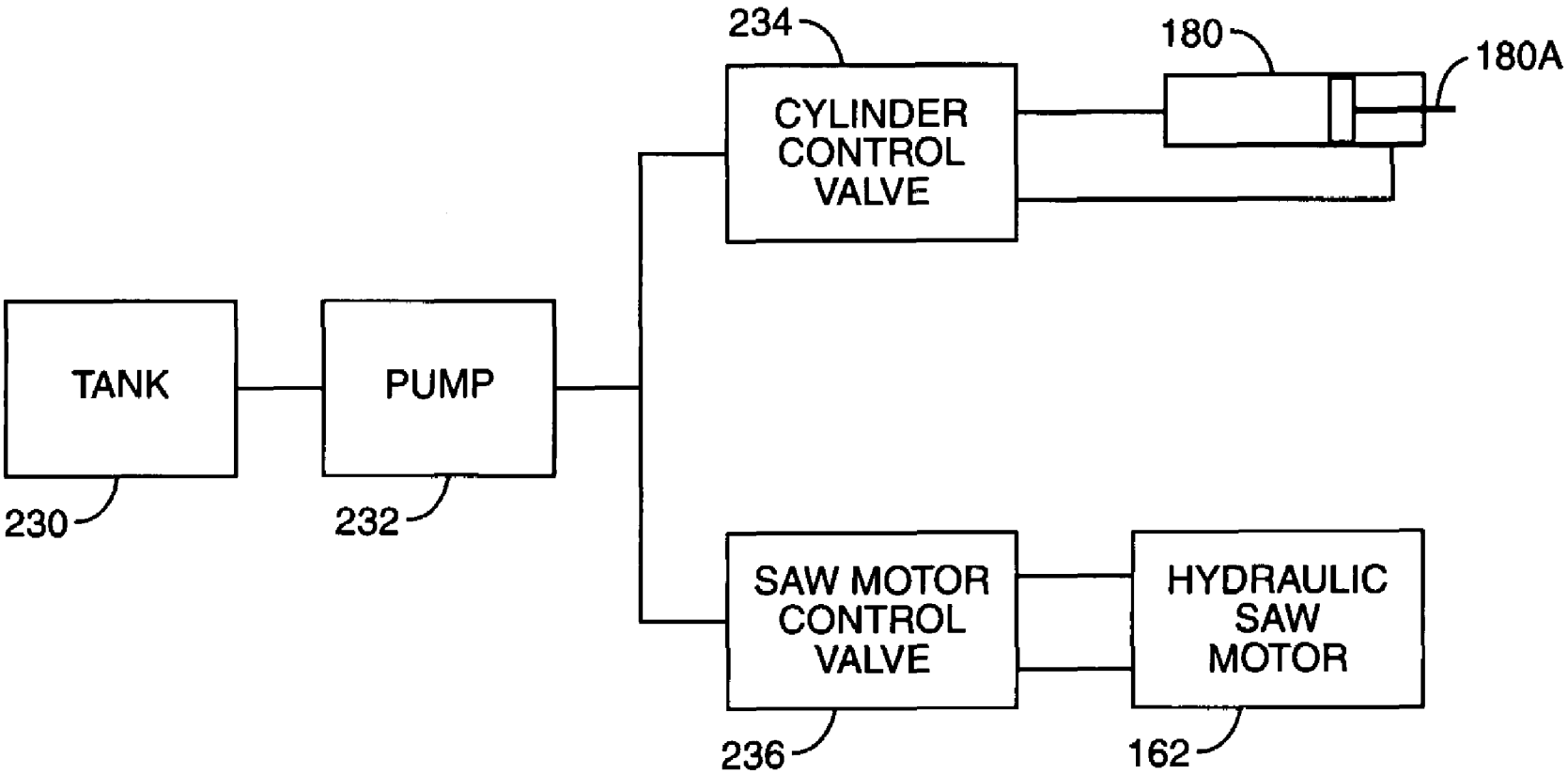
FIG. 6 is a schematic illustration of the hydraulic system that powers the machine.

To drive the concrete saw 160 and to power the double acting hydraulic cylinder 180, hydraulics are used. Since the front-end loader 12 includes its own onboard hydraulic system, then it follows that the hydraulic system of the front-end loader 12 can be utilized to power the concrete hole cutting machine 10. In FIG. 6 a schematic of a hydraulic system is shown and indicated generally by the numeral 96. A fluid tank 130 and a pump 232 would typically be provided onboard the front-end loader 12. A pair of hydraulic lines, a supply line and a return line, would be provided from the front-end loader 12 to the concrete hole cutting machine 10. In particular, the pump 232 would be connected to a cylinder control valve 234. Typically the cylinder control valve 234 would be a three positioned valve that would direct hydraulic fluid into the anchor end or the rod end of the hydraulic cylinder 180 depending on whether the second frame structure 60 is being extended or retracted. This control valve would also include a neutral position. Pump 232 would also supply fluid to a saw control valve 236. The saw control valve would in turn direct fluid to the hydraulic motor 162 which is associated with the saw unit 70. The saw control valve 236 would be a two position control valve or could be provided with a lock to assure that the saw was only driven in one direction. This is because the teeth on the lower periphery of the drum saw 160 could be damaged if the saw 160 is ran in reverse while the teeth are engaged with the underlying concrete. It should also be appreciated that appropriate relief valves would be provided in customary locations. For example, a relief valve would be provided in connection with the hydraulic motor 162 that drives the saw 160 and appropriate relief valves would be provided with they hydraulic cylinder 180 so as to provide appropriate relief when the valve is actuated and the rod or piston has reached an extreme position within the cylinder.

Figure 3:
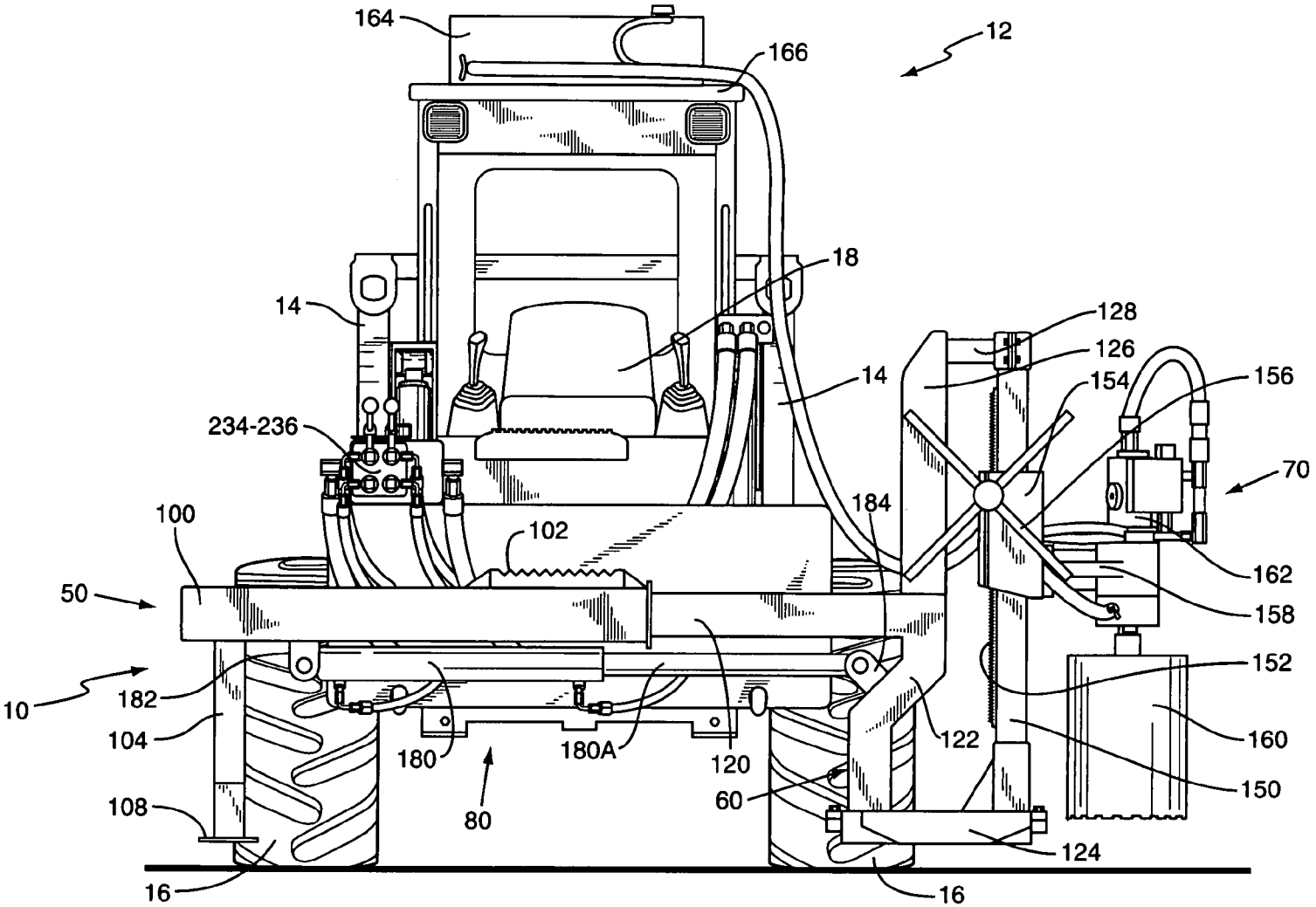
FIG. 3 is a view similar to FIG. 2, but with the machine in an extended position.

In the schematic of FIG. 6 the cylinder control valve is referred to separately by the numeral 234 while the saw motor control valve is referred to separately by the numeral 236. However, in practice these two valves may be consolidated into a single valve structure with a pair of levers, one lever operating one valve and the other lever operating the other valve. Such a consolidated valve structure is shown on the hole cutting machine 10 in FIGS. 1–3 and referred to by the numerals 234, 236.

Figure 5:
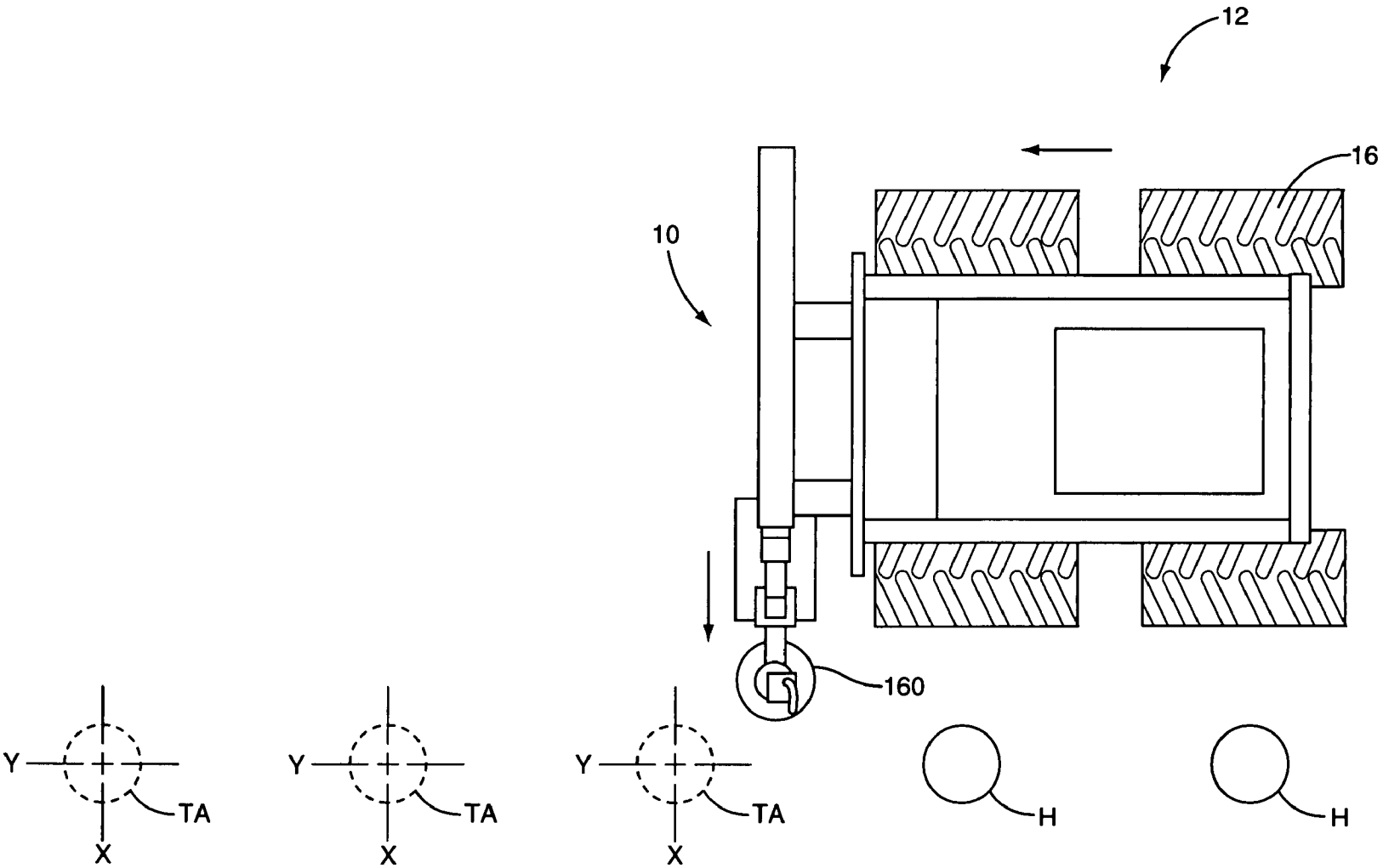
FIG. 5 is a schematic illustration showing the operation of the machine.

FIG. 5 is a schematic illustration of how the concrete hole cutting machine 10 works. As illustrated therein, there are three target areas TA formed in a concrete slab. The location of these target areas can be identified by surveying instrumentation such as a laser beam. For purposes of explaining the operation of the machine 10, each target area TA is said to include an X axis and a Y axis. Typically in a warehouse, the target areas will be laid out in alignment with a certain spacing between consecutive target areas. In some cases the target areas TA can be random. In order to cut holes in the target areas TA, the front end loader 12 with the concrete hole cutting machine 10 mounted thereon, is driven onto the concrete slab. The lift arms 14 of the front-end loader 12 are at least slightly up such that the feet or support structure of the concrete hole cutting machine 10 clears the underlying concrete slab. This permits the front-end loader 12 to transport the machine from location to location about the slab. In any event, in a case where the target areas TA are aligned, the front-end loader will move, as illustrated in FIG. 5, down a path adjacent to the line of target areas TA. That is, the front end loader 12 will be offset with respect to the alignment of the target areas TA. As the operator of the front-end loader approaches a first target area TA he or she will align the saw 160 with the X axis of the target area. Once the front-end loader is appropriately positioned such that the saw 160 aligns with the X axis of the target area TA, then the operator will extend the second frame structure 60. That is, control valve 234 is actuated so as to extend the rod 180A of hydraulic cylinder 180. This will cause the beam 120 to be extended and in the process will cause the saw 160 to be laterally shifted to the right as viewed in FIGS. 1 and 2. As the second frame structure 60 is laterally shifted, at some point, the saw 160 will become aligned with the Y axis of the particular target area TA. When the saw 160 becomes aligned with the Y axis then the saw 160 will be vertically aligned with the underlying target area TA. Now the operator will adjust the lift arms 14 of the front-end loader 12 causing the concrete hole cutting machine 10 to be set down on the concrete slab. In particular, the machine 10 is lowered to where the feet structure engages the concrete slab and effectively support the machine 10. To provide additional stability, the lift arms 14 or the hydraulic controls that control the position of the adapter 20 can be caused to apply a downward force on the machine 10 so as to make the machine even more stable.

Once the machine 10 has been lowered into engagement with the concrete slab and the saw 160 properly aligned with the underlying target area TA, then the operator actuates the saw control valve 236. This causes the saw 160 to rotate. Next the operator turns the spoke wheel 156 clockwise as viewed in FIGS. 1 and 2 causing the saw 160 to be lowered into engagement with the concrete slab. Once the teeth of the saw 160 engage the slab, then operator slowly applies pressure to the spoke wheel 156 and moves the saw 160 through the concrete slab, cutting a hole H or a cylindrical chunk of concrete from the slab. Once the hole H is cut in the slab, the saw 160 is moved upwardly from engagement with the slab, and the front-end loader 12 raises the concrete hole cutting machine 10 from engagement with the slab. Now the front-end loader 12 can be moved along the path illustrated in FIG. 5 to the next target area TA where the method is repeated.

There are many advantages to the concrete hole cutting machine 10 of the present invention. First and foremost it is a labor saver. By utilizing the machine 10 of the present invention, an operator can quickly and easily cut holes in a concrete slab by simply maneuvering the front-end loader from one location to another location on a concrete slab. It takes very little time to align the saw 160 with a target area TA, and once aligned, the machine can be positioned in a very stable posture such that the hole cut in the slab will be precise.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A concrete hole cutting machine adapted to be mounted to a front-end loader via an adapter, comprising:

a. a first frame structure;

b. a connector connected to the first frame structure for connecting to the adapter of the front-end loader so as to connect the first frame structure to the front-end loader;

c. a rotary concrete hole cutting saw;

d. a second frame structure supporting the saw;

e. the first and second frame structures including a telescoping structure that includes one member that slides back and forth in a second member, and wherein the telescoping structure is oriented with respect to the connector such that the second frame structure and saw can be moved back and forth laterally with respect to the front-end loader when the concrete hole cutting machine is connected to the front-end loader; and f. a hydraulic cylinder interconnected between the first and second frame structures for moving the second frame structure and the concrete cutting saw laterally back and forth between a retracted position and an extended position.

2. The concrete hole cutting machine of claim 1 wherein the telescoping structure includes an elongated tube forming a part of the first frame structure and an elongated member forming a part of the second frame structure and wherein the elongated member is telescopically disposed in the elongated tube.

3. The concrete hole cutting machine of claim 1 including first and second feet for engaging a concrete surface, wherein the first foot is associated with the first frame structure and the second foot is associated with a second frame structure.

4. The concrete hole cutting machine of claim 3 wherein the saw forms a part of a saw cutting unit that includes a vertical post and an adjustable carrier movable up and down the vertical post and wherein the adjustable carrier supports the saw; and wherein the saw cutting unit is secured to the second foot and extends upwardly therefrom.

5. The concrete hole cutting machine of claim 1 wherein the first frame structure includes one or more members that interconnect the first frame structure with the connector.

6. The concrete hole cutting machine of claim 1 wherein the hydraulic cylinder includes a housing and a rod extending therefrom and wherein the hydraulic cylinder is anchored to the first frame structure and wherein the rod thereof is connected to the second frame structure.

7. The concrete hole cutting machine of claim 1 wherein the machine includes the front-end loader, the front-end loader having a pair of lift arms that during a concrete hole cutting operation force the first and second frame structures downwardly into engagement with a concrete surface in which a hole is being cut.

8. The concrete hole cutting machine of claim 1 including a pair of hydraulic control valves, one hydraulic control valve operatively connected to the hydraulic cylinder for actuating the cylinder, and the other hydraulic control valve operatively associated with a hydraulic motor that drives the saw.

9. The concrete hole cutting machine of claim 1 wherein the connector for connecting the first frame structure to the front-end loader includes a plate that mates with the adapter of the front-end loader so as to connect the first frame structure with the front-end loader.

10. A method of cutting a hole in a concrete slab with a concrete hole cutting machine having a rotary hole cutting saw where the machine is mounted to a front-end loader, comprising:

a. supporting the concrete hole cutting machine off the surface of the concrete;

b. moving the front-end loader and the concrete hole cutting machine to a position where the saw is located in the vicinity of where a hole is to be cut into the concrete;

c. shifting the saw relative to the front-end loader to where the saw aligns with the area where the hole is to be cut into the concrete;

d. lowering the concrete hole cutting machine into engagement with the concrete in an area adjacent where the hole is to be cut in the concrete; and e. lowering the saw into engagement with the concrete and cutting a hole into the concrete.

11. The method of claim 10 wherein the concrete hole cutting machine includes a frame structure and wherein the method includes utilizing the front-end loader to apply a downward force on the frame structure and causing the frame structure to engage the concrete so as to stabilize the frame structure while the saw cuts a hole in the concrete.

12. The method of claim 11 wherein the front-end loader includes a pair of lift arms and wherein the lift arms are operative to raise and lower the concrete hole cutting machine and wherein the downward force applied to the concrete hole cutting machine is applied through the lift arms of the front-end loader.

13. The method of claim 10 wherein the concrete hole cutting machine includes a first frame structure and a second frame structure and wherein the second frame structure supports the concrete saw and is laterally shiftable back and forth with respect to both the first frame structure and the front-end loader.

14. The method of claim 10 wherein a series of holes are cut into a concrete surface by moving the front-end loader from one location to another location and shifting the saw back and forth to the front-end loader.

15. The method of claim 10 wherein a target area defines where a hole is to be cut within the concrete and wherein the method includes positioning the front-end loader to align the saw with one axis of the target area and shifting the saw with respect to the front-end loader to align the saw with a second axis of the target area.

16. The method of claim 10 wherein the step of shifting the saw relative to the front-end loader includes laterally shifting the saw relative to the front-end loader.

17. A concrete hole cutting machine adapted to be mounted to an adapter of a front-end loader, the concrete hole cutting machine comprising:

a. a connector for connecting to the adapter of the front-end loader;

b. an elongated tube fixed relative to the connector;

c. a first foot extending downwardly for supporting the elongated tube;

d. an elongated beam at least partially confined within the elongated tube and movable back and forth therein, the elongated beam including an end portion that extends from the tube, and wherein when the concrete hole cutting machine is mounted to the front-end loader, the elongated beam extends transversely with respect to the front-end loader;

e. a second foot movable back and forth with the elongated beam and adapted to at least partially support the elongated beam;

f. a hydraulic cylinder operative to drive the beam back and forth within the elongated tube;

g. a concrete hole cutting saw unit that moves back and forth with the elongated beam and includes a drum type rotary saw for cutting a hole in concrete; and h. wherein the saw can be aligned with a target area in the concrete by selectively positioning the concrete hole cutting machine and moving the elongated beam back or forth within the elongated tube.

18. The concrete hole cutting machine of claim 17 wherein the elongated beam supports the saw cutting unit and the elongated tube supports the elongated beam such that when the concrete hole cutting machine is lifted clear of a concrete slab of the front-end loader, the elongated beam and saw cutting unit are effectively supported by the elongated tube.

19. The concrete hole cutting machine of claim 18 wherein the elongated tube and connector form a part of a first frame structure and the elongated beam forms a part of a second frame structure, and wherein the saw cutting unit is mounted on a support that is connected to the elongated beam.

20. The concrete hole cutting machine of claim 17 wherein the connector, elongated tube and first foot form a part of the first frame structure, wherein the elongated beam and second foot form a part of a second frame structure and wherein the second frame structure is movable back and forth with respect to the first frame structure, and wherein the second foot forms a part of a platform that supports the cutting saw unit, with the cutting saw unit projecting upwardly from the support and having a circular concrete saw mounted thereon and movable up and down relative to the concrete hole cutting machine.

21. A method of cutting a hole in a concrete slab where the hole is to be cut in a target area, comprising: moving a concrete hole cutting machine to where a hole cutting saw horizontally aligns with the target area; laterally shifting a first portion of the concrete hole cutting machine having the hole cutting saw mounted thereon with respect to a second portion of the concrete hole cutting machine, and shifting the first portion to where the hole cutting saw vertically aligns with the target area; and moving the hole cutting saw downwardly to engage the target area in the concrete slab and cutting a hole in the concrete slab.

22. The method of claim 21 wherein the concrete hole cutting machine is mounted to a prime mover having a lift that lifts the concrete hole cutting machine such that the concrete hole cutting machine can be moved from one location to another location.

23. The method of claim 22 including during the hole cutting operation applying a downward force on the concrete hole cutting machine such that the machine is forced against the underlying concrete slab which tends to stabilize the machine during the hole cutting operation.

24. A concrete hole cutting machine for supporting a concrete hole cutting saw and adapted to mount to at least one lift arm of a prime mover, comprising: a connector for mounting the concrete hole cutting machine to the lift arm of the prime mover; a first frame structure coupled to the connector; a second frame structure extendably and retractably coupled to the first frame structure and adapted to support the concrete hole cutting saw and being movable back and forth with respect to the first frame structure; an actuator forming a part of a concrete hole cutting machine for extending and retracting the second frame structure with respect to the first frame structure; and wherein the position of the concrete hole cutting saw supported by the second frame structure is adjustable by actuating the actuator and extending or retracting the second frame structure with respect to the first frame structure.

25. The concrete hole cutting machine of claim 24 wherein the first and second frame structures include a telescoping structure that enables the second frame structure to be extended or retracted with respect to the first frame structure.

26. The concrete hole cutting machine of claim 24 including a concrete hole cutting saw supported by the second frame structure and movable back and forth therewith.

27. The concrete hole cutting machine of claim 24 including at least one foot for engaging the surface of a concrete slab during a hole cutting operation.

28. The concrete hole cutting machine of claim 27 wherein there is provided one foot that extends from the first frame structure and a second foot that extends from the second frame structure and wherein the first and second feet engage the surface of a concrete slab during a hole cutting operation.

29. The concrete hole cutting machine of claim 24 including a water tank that is adapted to be mounted to the prime mover, and wherein there is provided a water supply line that extends from the water tank to the concrete hole cutting saw.

30. The concrete hole cutting machine of claim 24 wherein the second frame structure includes a platform for supporting the concrete hole cutting saw and wherein the concrete hole cutting saw is secured to the platform and extends upwardly therefrom and includes a rotary cutting saw that is movable up and down with respect to the second frame structure.

31. A method of cutting a hole in concrete using a concrete hole cutting machine coupled to a front-end loader arm, comprising the steps of:

a. connecting a first frame structure to a front-end loader arm;

b. connecting a second frame structure to the first frame structure in an extendible and retractable manner;

c. supporting a concrete hole cutting saw unit on the second frame structure;

d. maneuvering the front-end loader onto a concrete slab;

e. positioning the hole cutting saw unit by extending or retracting the second frame structure with respect to the first frame structure; and f. actuating the hole cutting saw unit to cut a hole in the concrete slab.

* * * * *